United States Patent [19]

Boyd et al.

[11] Patent Number: 4,597,750

[45] Date of Patent: Jul. 1, 1986

[54] INSERTION OF DRAW TAPE STRIPS IN DRAW TAPE BAG MANUFACTURE

[75] Inventors: Dana M. Boyd, Rushville; Vernon C. Catchman, Palmyra; Kevin Broderick, Victor, all of N.Y.

[73] Assignee: Mobil Oil Corporation, New York, N.Y.

[21] Appl. No.: 652,252

[22] Filed: Sep. 20, 1984

[51] Int. Cl.[4] ..... B05B 1/14

[52] U.S. Cl. ..... 493/346; 493/194; 493/225; 493/381; 493/928

[58] Field of Search ..... 493/225, 928, 194, 196, 493/199, 213, 231, 239, 243, 248, 346, 357, 362, 369, 381, 246, 255, 440, 447, 456, 461, 195, 197, 202; 112/141, 147, 152, 137, 121.26, 121.27; 226/197

[56] References Cited

U.S. PATENT DOCUMENTS

| | | | |
|---|---|---|---|
| 2,777,491 | 1/1957 | Ashton et al. | 493/209 |
| 2,798,523 | 7/1957 | Barrett | 493/225 |
| 2,897,729 | 8/1959 | Ashton et al. | 493/225 |
| 2,900,934 | 8/1959 | Judelson | 226/197 |
| 3,058,403 | 10/1962 | Kugler | 493/194 |
| 3,196,757 | 7/1965 | Samways | 493/225 |
| 3,512,456 | 5/1970 | Meyer | 493/928 |
| 3,687,357 | 8/1972 | Hansen | 229/63 |
| 3,738,567 | 6/1973 | Ruda | 229/62 |
| 3,772,968 | 11/1973 | Ruda | 493/225 |
| 3,803,990 | 4/1974 | Pedersen | 493/243 |

*Primary Examiner*—Lowell A. Larson
*Assistant Examiner*—Robert Showalter
*Attorney, Agent, or Firm*—Alexander J. McKillop; Michael G. Gilman; Charles J. Speciale

[57] ABSTRACT

A method of inserting a continuous, pliable strip into each hem formed along an edge, an edge of one of a pair of superposed panels forming an elongated, continuous web, the hem being formed by turning an edge portion of a panel inward between the panels. Each strip is fed from a position outside the web on the hemmed side of the web, across the hem(s) to a position between the panels within the web, reversed in direction and fed to a position between the portions of the panel forming a hem. Each strip is then turned from a transverse direction to a longitudinal direction and fed longitudinally into the hem. An apparatus for performing the steps of the method is described for use in the manufacture of thermoplastic film draw strip bags and feeds a pair of extremely thin and flexible plastifilm strips into a pair of hems, each formed in one of a pair of superposed panels, eventually forming the sides of the finished bag. A suitable mechanism such as pinch rollers are provided downstream from the apparatus for advancing the web through the apparatus and drawing the web with inserted strips away from the apparatus.

14 Claims, 9 Drawing Figures

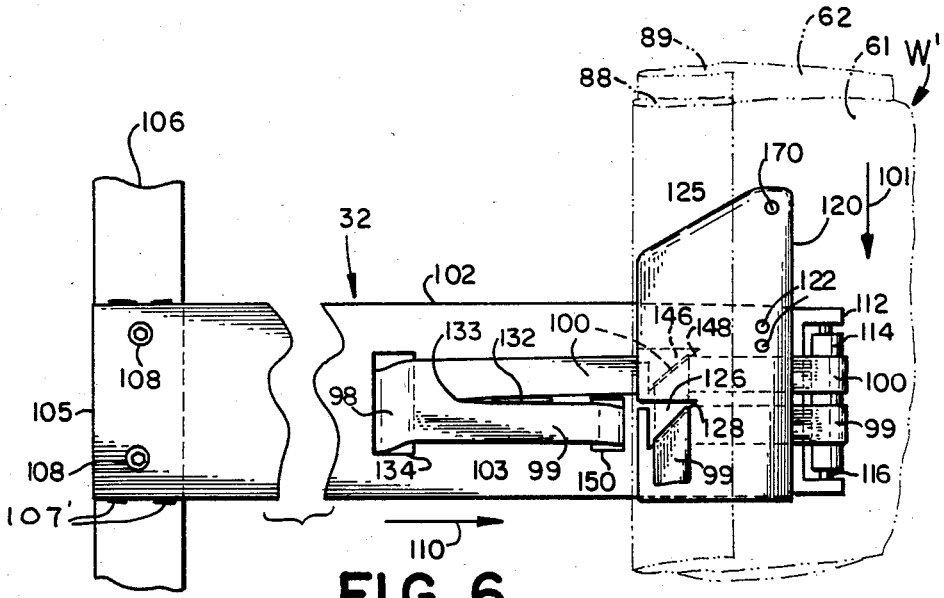
FIG. 6
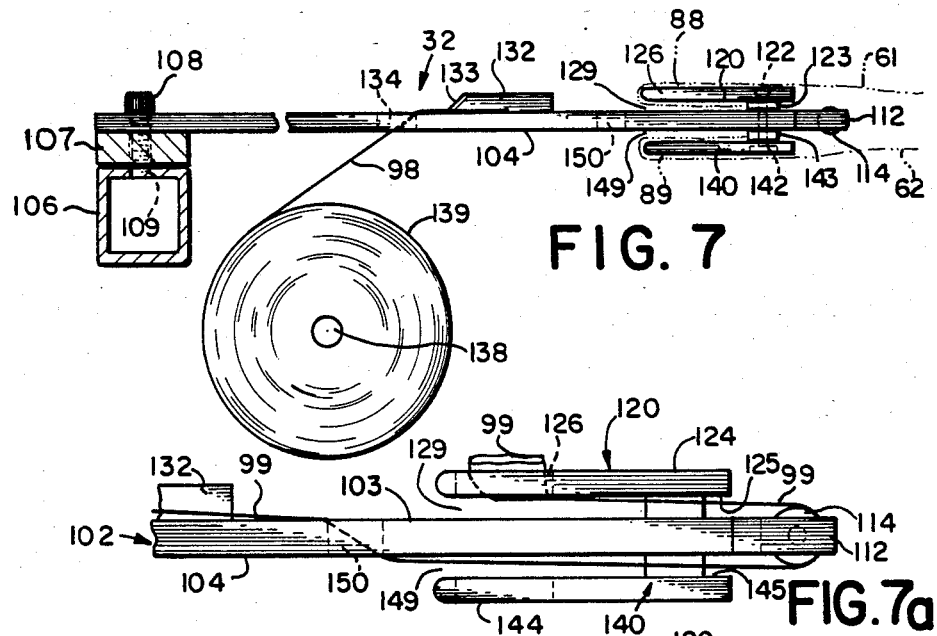
FIG. 7
FIG. 7a
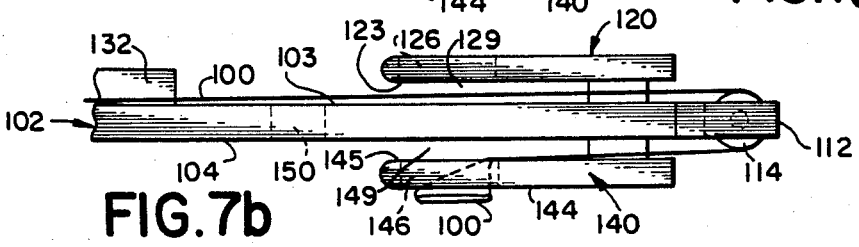
FIG. 7b

INSERTION OF DRAW TAPE STRIPS IN DRAW TAPE BAG MANUFACTURE

FIELD OF THE INVENTION

The invention relates to insertion of a continuous strip of material into a continuous fold of a continuous moving web, and, in particular to the simultaneous insertion of continuous strips of thermoplastic film or other pliable material into each of two adjoining hems folded in superposed panels of a continuously moving web which is suitable for use in the manufacture of draw strip bags.

BACKGROUND OF THE INVENTION

Thermoplastic draw tape or strip bags are widely known. Such bags are formed from superposed thermoplastic panels typically heat sealed along their bottom or two side edges in having an open side or mouth bordered by a sealed tube. The tube is formed by turning over or hemming the panel material and sealing the edge of the turned portion of the material to the opposed connected portion of the panel to form the tunnel structure. The tunnel structure of each panel typically contains a separate draw strip. Openings through the tunnel structure on either side of the mouth allow access to the strip therein which, when drawn through the opening, cinches the bag mouth closed and provides handles for carrying the bag.

A number of patents, particularly U.S. Pat. Nos. 2,777,491, 2,897,729, and 3,512,456, depict the manufacture of draw string bags by outwardly hemming (i.e., outwardly turning) the adjoining free edges of a once folded plastifilm web and inserting strings into the folds of the hem from a position opposite the fold. This method produces an exposed, hemmed edge on the outer surface of the bag which is not aesthetically pleasing.

The method typically employed to make draw tape bags with inwardly folded hems is shown in U.S. Pat. Nos. 2,798,523, 3,196,757, 3,738,567 and 3,772,968 and consists of applying the tape strips near either side edge of an unfolded plastifilm web, folding the edges towards one another over the strips to form a pair of hemmed tunnels containing the strips and then centralling folding the web with the turned in hems facing one another. All this produces a satisfactory product, a great deal of floor space must be provided in manufacture so as to be able to deal with the originally unfolded web.

In the manufacture of other types of bags, a pliable strip is sometimes inserted into the fold of a once folded web from a position outside and opposite to the fold. In particular, U.S. Pat. No. 3,803,990 describes the used of guide member extending transversely between the panels of a once folded continuous web to a position near the fold. A continuous strip of pliable material is fed along the guide to a turning edge oriented at 45° to the longitudinally direction of the web and transverse direction of the guide and turned over the edge so as extend longitudinally, i.e., parallel to the fold. U.S. Pat. No. 3,687,357 depicts the fabrication of draw string bags in which a pair of strings are fed into either outwardly turned or inwardly turned hemmed edges of a continuous plastifilm web. The actual insertion device used is only diagrammatically depicted and is not otherwise described.

SUMMARY OF THE INVENTION

It is an object of the invention to provide a method and device for inserting a pliable, continuous strip into a hem formed in one of a pair of superposed, continuous panels by turning an edge portion of the one panel between the panels.

It is another object to provide such a method and device for inserting said strip while said superposed panels pass continuously and uninterruptedly past the device.

It is another object of the invention to provide such a method and device which uses compressing rollers or equivalent apparatus located downstream from the device and provided for advancing the panels to also advance the strip(s) through the device.

It is another object of the invention to provide a device which performs as indicated and is of simple mechanical construction.

It is yet another object of the invention to provide a device which performs as indicated and is compact in size.

It is yet another object to provide a device which is suitable for inserting thin, plastifilm strips into inwardly turned hems of superposed thin, plastifilm panels moving past the device at high speed, from the hem side of the panels.

It is yet another object to provide a method and device for continuously and interruptedly inserting thermoplastic film draw tape strips in previously hemmed, centrally folded, superposed thermoplastic film bag stock as part of a draw tape bag manufacturing line.

It is another object to provide such a device which positions said strips in the hems continuously and at high speed without buckles or folds.

These and other objects are provided by a device fixedly supported on the side of a continuously moving web formed by a pair of superposed panels of pliable material, one or both of the panels having an inwardly turned longitudinal edge forming a hem on the side of the web adjoining the device. A transverse member of the device extends from a position outside the web to an extreme position between the panels and overlapping the hems separating the panels from one another. Another member is mounted to a side of the transverse member facing a hemmed panel of the web and extends from near said extreme position beyond the hem to a position within the hem and separates the facing panel portions defining the hem. The other member is raised from the opposing surface of the transverse member and the space therebetween receives the turned-in edge portion of the panel defining the hem. The other member has a hole therethrough with a turning edge oriented approximately 45° to both the transverse direction of the transverse member and longitudinal direction of the web so as to turn a draw tape strip fed between the panels along the opposing side of the arm, reversed at the extreme edge of the arm and through the hole from a transverse direction to a longitudinal direction substantially parallel with the longitudinal orientation of the hem.

According to one aspect of the invention, the members forming the device may consist essentially of flat plates.

According to another aspect of the invention, a pair of such plates or members are provided on either side of the transverse arm so as to simultaneously insert strips into pairs of hems, each hem being provided in a separate panel.

BRIEF DESCRIPTION OF THE DRAWING

The aforesaid objects and aspects and other objects and aspects of the invention are better understood with reference to the following description and attached drawings in which:

FIG. 6 depicts diagrammatically the device of the subject invention in plan view;

FIG. 7 is a side view of the device of FIG. 6; and

FIGS. *7a* and *7b* depict in simplified side views, the feed paths of the two draw tape strips fed by the device of FIG. 6 and 7.

DETAILED DESCRIPTION OF THE INVENTION

Figure 1:
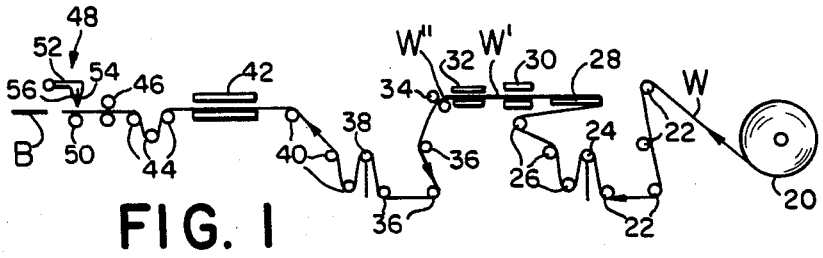
FIG. 1 depicts very diagrammatically a draw tape, thermoplastic film bag manufacturing line incorporating an embodiment of the subject invention.
Figure 3:
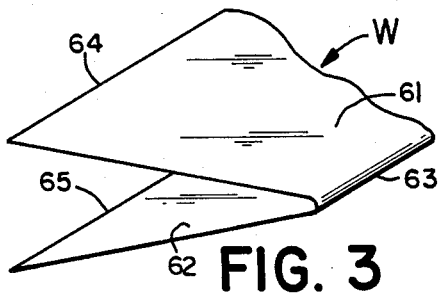
FIGS. 3–5 depicts a continuous thermoplastic web fed through the bag manufacturing line of FIG. 1 in various states of process.
Figure 4:
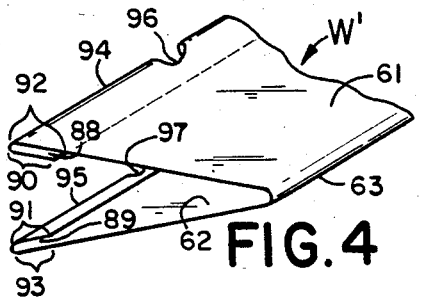
Figure 5:
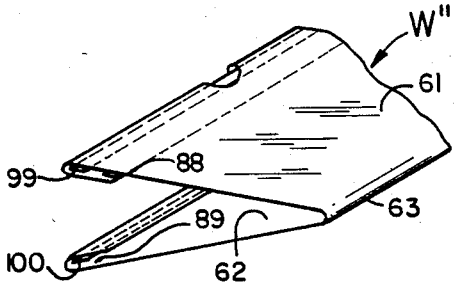

FIG. 1 depicts a line for the manufacture of thermoplastic film draw tape bags. The line is the subject of a separate related, co-pending application Ser. No. 652,254 filed Sept. 20, 1984, assigned to the assignee of this application and incorporated by reference herein. A web, referred to at various states in its progress through the line as W,W′ and W″ is drawn by means of a pair of pinch rollers 34 or comparable means continuously and uninterruptedly from a roll 20 past fixed idler rollers 22, over a dancer roller 24 controlling a brake associated with the roll 20 past additional fixed idler rollers 26, over a hem forming board 28, through an intermittently reciprocating punch 30 and a draw tape strip inserting device 32 of the subject invention. A related, co-pending application Ser. No. 652,255, filed Sept. 20, 1984, assigned to the assignee of this application and incorporated by reference herein, describes a hem forming apparatus 28 used with the line. Another related, co-pending application Ser. No. 652,253 filed Sept. 20, 1984, and assigned to the assignee of this application describes a method and apparatus for simultaneously feeding a pair of thin plastic film ribbons from a pair of rolls. As is indicated in FIG. 3, the web W as it is fed from the roll 20 consists of a continuous sheet of thermoplastic film medianly folded so as to provide a longitudinal fold edge 63 and a pair of superposed panels 61 and 62 with longitudinal side edges 64 and 65. The panels are separated in FIG. 3 for clarity but are superposed in continuous contact with one another between the roll 20 and rollers 34 except for part of their passage across the hem former 28 and past the draw tape strip inserter 32. The condition of the web as it exits the punch 30, now referred to as W′, is depicted in FIG. 4. The hem former 28 has inwardly turned, longitudinal edge portions 90 and 91 of the panels 61 and 62, respectively, so as to form hems 88 and 89, respectively. The folded portions 90 and 91 face intermediate portions 92 and 93, respectively, of the two panels. Holes 96 and 97 are cut by means of the punch 30 (FIG. 1) in the longitudinal hemmed edges of each panel 61 and 62 to provide access to the to be inserted draw tape strips. FIG. 5 depicts the web, now identified as W″, as it exits from the draw tape strip inserter 32 of the subject invention with a continuous draw tape strip 99 and 100 in each hem 88 and 89, respectively. The rollers 34 are used to advance the strips 99 and 100 through and from the inserter as they continuously advance the web. Again, the panels and turned in edge portions of the webs W′ and W″ are separated from one another in FIGS. 4 and 5 for clarity; the folded portions of the web and the strips are actually in superposed contact with one another on leaving the hemmer 28, punch 30 and inserter 32.

Referring again to FIG. 1, a second pair of nip rollers 46 intermittently advance the web W″ past fixed idler rolls 36 over a dancer roll 38, provided for accumulating the web when the rollers 46 are halted, past additional idler rollers 40, through a hem sealer 42 and over U-wrap rollers 44. The hem sealer 42 forms a longitudinal heat seal between each pair of panel portions 90–92 and 91–93 to form a sealed tunnel structure containing the strips 99 and 100, respectively. The nip rollers 46 intermittently advance bag width lengths of the web W″ to a transverse sealer/cutter apparatus 48 which is formed by a roller 50 and reciprocating arm 52. The arm 52 includes a heat seal head 54 containing a knife edge 56. The arm simultaneously transversely seals and cuts the web so as to provide individual bag bodies B.

Figure 2:
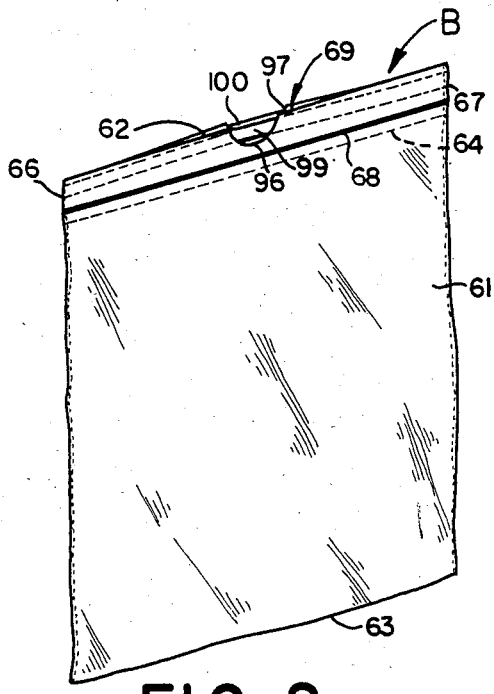
FIG. 2 depicts a draw tape bag manufactured by the line of FIG. 1.

A bag produced by the line of FIG. 1 is depicted in FIG. 2. In addition to the previously identified features and structural elements, the bag B includes heat sealed side edges 66 and 67 and a horizontal heat seal in each hem, the hem seal 68 of panel 61 being depicted. The hem portions are unattached to one another except at the side edges 66 and 67 so as to provide a mouth 69 at the top of the bag. The strips 99 and 100 are also heat sealed to the overlapping portions of the panels 61 and 62 at the side edges 66 and 67.

FIGS. 6 and 7 are plan and side views, respectively, of the device 32 according to the subject invention incorporated into the draw tape bag line depicted diagrammatically in FIG. 1. The device 32 comprises a transverse member or arm 102 formed by a plate having an initial end 105 fixedly mounted by bolts 108 or other suitable means to a rigid frame member 106. A spacer block 107 is provided to raise the apparatus 32 so that plate 102 lies in the plane of the web W′ as it is fed between the punch and downstream rollers (see FIG. 1). The block 107 is attached to frame member 106 by welds 107′ (see FIG. 6). Threaded bores 109 (one depicted in FIG. 7) are tapped through spacer 107 and member 106 to receive bolts 108. The arm 102 extends from its fixed end 105 between the panels 61 and 62 of the web W′ in a direction, indicated by the arrow 110, substantially transverse to the longitudinal running direction of the web, indicated by the arrow 101. The extreme end 112 of the arm 102 spans both hems 88 and 89 of the web W′. At the extreme end 112 of the arm, an idler roller 114 is supported on an axle 116 fixed to the arm 102 and is provided to reverse the direction of draw tape strings 99 and 100. If desired, a turning surface can be machined directly into the arm 102. As is better seen in FIG. 7, a different one of a pair of additional substantially planar members or feet 120 and 140 are mounted to the upper major planar surface 103 and opposing lower major planar surface 104, respectively, of the arm 102 near its extreme end 112 and their major surfaces. The feet are substantially planar parallel with the plate 102 and a plane defined by the web W′. Each of the members 120 and 140 is spaced away from the facing surface of the arm by a pylon 123 or 143, respectively, or other suitable spacers. Screws 122 extending from the upper plate 120 through the pylon 123, arm 102 and into threaded bores (not depicted) in the lower member pylon 143 and member 140 fix the members 120 and 140 to the arm 102. The forward edge portion 125 of member 120 and and a symmetric portion of member 140 each separate a turned in edge portion of the panel 61 or 62 forming a hem from the facing intermediate portion of the panel forming the remaining side of the hem and simultaneously feed a draw tape strip 99 or 100 between the separated panel parts. To that end, each member 120 and 140 has a pylon or spacer 123 and 143, respectively, spacing the remaining portion of the arm 120 and 140 from the opposing surface 103. The pylons 123 and 143 each provide a gap 129 and 149 between the transverse arm 102 and one of the two members 120 and 140, respectively. The gaps 129 and 149 each receives a turned in edge portion of the separate panel 61 and 62, respectively, of the web W'. The arm 102 separates the panels 61 and 62 to allow the strips 99 and 100 to be fed between the panels. A knife blade 132 having a forward cutting edge 133 is fixedly mounted to the arm 102 outside the web W' and divides a wider thermoplastic film strip 98, fed from a roll or other suitable source 139 (see FIG. 7 only) beneath the arm 102, through an opening 134 in the arm.

The feed paths of the two draw tape strips 99 and 100 are depicted diagrammatically in FIGS. *7a* and *7b*, respectively. Referring to FIG. *7a*, the draw tape strip 99 leaves the knife 132, passes through an opening 150 in the member 102 to the lower planar surface 104 of the member 102, is reversed on the roller 114 at the extreme end 112 of the arm 102 and travels back along the upper planar surface 103 of the arm through an opening 126 in the upper plate member 120. As is best seen in FIG. 6, the opening 126 in the upper plate 120 is triangular in form and has a turning edge 128 forming a hypotenuse of the triangle. The turning edge 128 is at an approximately 45° angle to the longitudinal direction 101 of the fed web W' and to the transverse direction 110 of the arm 102. The edge 128 turns the strip 99 from said transverse direction to said longitudinal direction. The strip 99 plays out from the edge 128 over the upper surface 124 of the upper member 120 and is pulled away with the web W' by the downstream nip roller 34 (see FIG. 1).

The feed path of the second draw tape strip 100 is shown in FIG. *7b*. The strip 100 leaves the knife 132, travels over the upper surface 103 of the member 102 to the extreme end 112 where it is reversed around the roller 114, passes along the lower planar surface 104 of the transverse member 102 to the inner planar surface 145 of the lower member 140, and through an opening 146 in the lower member 140. Like the strip 99, the strip 100 passes over a turning edge 148 (indicated in phantom in FIG. 6) oriented approximately 45° to the transverse direction 110 of the arm 102 and longitudinal direction 101 of the fed web W* and is fed from the device 32 along the outer (lower) surface 144 of the lower member 140. It, too, is drawn away by the nip rollers 34 (see FIG. 1).

The upper and lower members 120 and 140 are substantially symmetric, the major non-symmetric feature being the location of the openings 126 and 146. As is depicted in FIG. 6, they are spaced longitudinally from one another so as to be aligned with the longitudinally spaced strips 99 and 100.

The pylon or spacing members 123 and 143 (see FIG. 7) are located near the upper edge of the arm 102 as shown in FIG. 6, so as not to interfere with the feed path of the strips 99 and 100. To improve the stability of the members 120 and 140, an additional screw 170 is passed through one member 120 and into a threaded bore in the opposing member 140 at a location near the extreme side of the members, near the upstream edge 125 of the member 120. The screw 170 is positioned so as to lie beyond the hems 88 and 89 and therefore not interfere with the feed of the web W'.

While the device has been shown in a preferred embodiment for use in a thermoplastic film draw tape bag manufacturing line, the same device could be used to feed other pliable strips such as fabrics or metal foils and can be used with other types of webs, particularly fabric webs. If desired, the upper and lower members 120 and 140 can be given a more rounded and elongated shape if desired to prevent the likelihood of snagging of the web material. While the knife 132 is shown mounted to the member 102, it could be separately mounted and moved into position for operation on the upper surface 103 of that member, if desired.

While various modifications and changes have been suggested, others will occur to those skilled in the art and the invention is not limited to the described embodiment, but is rather set forth in the accompanying claims.

We claim:

1. An apparatus adapted for inserting a flat continuous strip of plastifilm or other pliable material into a hem formed along a edge of a continuous web comprising:

feed means for uninterruptedly feeding in a longitudinal direction a continuous web formed by two superposed, continuous panels, at least one of the panels having one longitudinal edge portion thereof folded inwardly between the panels and against a facing, intermediate portion of the one panel forming an inwardly turned hem along one longitudinal side of the web, the hem having a fold seam forming a longitudinal side edge of the one panel;

a strip guide arm fixedly positioned downstream from the feed means and extending transversely to the longitudinal direction of the fed web from an initial position outside the web near the one longitudinal side of the web to an extreme position between the panels and beyond the inwardly turned edge portion of the web and having a first planar side substantially parallel to the plane of the web for guiding a first flat continuous strip of pliable material from said initial position to said extreme position and an opposing planar side substantially parallel to the plane of the web for guiding said strip back from said extreme position toward said initial position;

reversing means near said extreme position of the arm for reversing the direction of a flat continuous pliable strip from said first side of the arm to said opposing side arm;

first hem separating means mounted to said arm adjoining said opposing side of the arm and extending from a position near said extreme position of the arm to a position between the folded edge portion and the facing intermediate portion of one panel of the web for separating said one panel portions from one another as they pass by the arm;

first turning means on said first hem separating means for receiving the strip extending along said opposing side of the arm and for folding the strip from said transverse direction, substantially parallel to the arm, to said longitudinal direction, substantially parallel to the length of the web, while feeding the strip out into the hem; and take up means downstream from the web feed means and the arm for continuously drawing said web and said strip from said arm.

2. The apparatus of claim 1 wherein the remaining panel of said web has a second inwardly turned hem adjoining and substantially parallel with the inwardly turned hem of the one panel and further comprising:

second hem separating means mounted to said arm adjoining said first side of the arm and extending from near said extreme position to between a folded edge portion and a facing intermediate portion forming said hem of said remaining panel for separating said two portions of the second hem from one another as they pass by the arm; and second turning means on said second separating means for receiving a second flat continuous strip extending along said first side of the arm from said reversing means and for folding said second strip from said transverse direction to said longitudinal direction while feeding the second strip into the second hem.

3. The apparatus of claim 2 wherein said first turning means and said second turning means are turning edges in said first and second separating means, respectively, oriented at approximately at a 45° angle to both the transverse direction in the arm and the longitudinal direction of the web.

4. The apparatus of claim 3 having means for feeding said two flat continuous strips side by side to a feed position outside said web on said first side of the arm and further comprising:

an opening extending between said first side and said opposing side of the arm and located along said arm between said feed position and said reversing means for passing only one of said two strips from said first side to said opposing side of the arm.

5. The apparatus of claim 4 further comprising:

cutting means mounted to said first side of the arm for splitting a single strip into said two side by side strips.

6. An apparatus for inserting a flat continuous strip of pliable material into a hem of a centrally longitudinally folded continuous web being fed uninterruptedly in a longitudinal direction of the web across a plane defined by a pair of parallel superposed panels forming the web, the hem being formed on one of the two superposed panels by inwardly folding a longitudinal free edge portion of the panel between the two superposed panels and against a connected facing intermediate portion of the one panel comprising:

means for feeding the continuous web in a longitudinal direction along a plane;

a fixed frame member;

a first elongated plate member mounted to the frame member and having a pair of opposing major planar surfaces substantially parallel to said plane, the plate member extending from an initial end mounted to said frame member transversely to said longitudinal direction of the web to an extreme end so as to extend between the superposed panels and span the hem, the elongated plate member further having at its said extreme end a first turning means substantially parallel with said longitudinal direction of the web for reversing the direction of a flat continuous pliable strip fed along one of said pair of major planar surface to the remaining major planar surface;

means for feeding a flat continuous, pliable strip to one of the major planar surfaces of the first elongated member near the initial end; and a second plate member having a pair of outer, opposing major planar surfaces substantially parallel to said plane and affixed to the first elongated plate member near its extreme end, one of the two major planar surfaces of the second plate facing the remaining planar surface of the elongated member, the second plate member extending from a position near said extreme end toward said initial end of the elongated member sufficiently so as to at least partially overlap the transverse width of the hem, the two plate members being separated so as to provide a gap between said remaining surface of the elongated member and a facing outer planar surface of the second plate member for receiving said inwardly turned portion of the hem of the web, the second plate member further having an opening extending between its outer major planar surfaces with a second straight turning edge oriented approximately 45° to both said longitudinal direction of the web and said transverse direction of the first elongated plate member for receiving the flat continuous pliable strip from said first turning means and folding the flat continuous pliable strip from said transverse direction to said longitudinal direction and feeding the strip out within said hem.

7. The apparatus of claim 6 wherein said web has a pair of superposed hems, the second hem being in the remaining panel of the web at said one longitudinal edge of the web, the second hem also being formed by turning in between the panels a longitudinal edge portion of the remaining panel, further comprising:

a third plate member having a pair of outer, opposing major planar surfaces substantially parallel to said plane, affixed to the elongated member near the extreme end with one of the two opposing major planar outer surfaces facing the one planar surface of the elongated member and extending, spaced from said elongated member one planar surface, from a position near said extreme end towards said initial end of the elongated member and so as to at least partially spanning the transverse dimension of said second hem and provide a gap between said one surface of the first elongated plate member and the facing major planar surface of the third plate member for receiving the inwardly turned portion of the remaining panel of the web forming the second hem, the third plate member further having an opening extending between its outer major planar surfaces with a third straight turning edge oriented approximately 45° to said longitudinal direction of the web and to said transverse direction of the first elongated plate member for folding a second flat continuous pliable strip from said transverse direction to said longitudinal direction and feeding said second strip out of the apparatus within the second hem.

8. The apparatus of claim 7 wherein the second and third plate members are substantially congruent with the exception that the openings of said two plates are spaced from one another in said longitudinal direction.

9. A method of inserting a flat continuous strip of pliable material into a hem formed by turning between a pair of superposed, continuous, elongated panels forming a continuous, elongated web, one elongated edge portion of the one panel against a facing, intermediate portion of the one panel, comprising the steps of:

feeding the superposed panels in a longitudinal direction;

feeding a flat continuous pliable strip transversely to the longitudinal direction of the web and elongated direction of the hem along a first plane between the superposed panels and across the hem;

reversing the direction of the strip between the superposed panels;

transversely feeding the reversed strip along a second plane substantially parallel to and transversely displaced from the first plane and between the turned in edge portion and the facing portion of the one panel;

folding said strip within the hem from said transverse direction to said longitudinal direction; and feeding the longitudinally directed folding strip along a third plane substantially parallel with and displaced from said first and second planes into the hem.

10. The method of claim 9 wherein the remaining panel of the web is provided with a hem superposed with the original hem and similarly formed by turning in one elongated edge portion of the remaining panel against a facing intermediate portion of that panel, further comprising after the first feeding step the steps of:

feeding a second flat continuous pliable strip transversely to the longitudinal direction of the web in elongated direction of the second hem between the superposed panels and across the second hem;

reversing the direction of the second strip;

transversely feeding the reversed second strip between the turned in edge portion and facing portion of the remaining panel forming the second hem;

folding said second strip within the second hem from said transverse direction to said longitudinal direction; and feeding the longitudinally directed second strip into the second hem.

11. The method of claim 10 further comprising the step of:

contemporaneously with said previous steps, continuously and uninterruptedly advancing the web and inserted strip away from means performing the previous steps.

12. A method of inserting a flat continuous strip of pliable material into a hem formed in one of a pair of superposed elongated panels forming a continuous elongated web, the hem being formed along one side of the web by inwardly turning an edge portion of the one panel along said one side of the web between the two said panels and against an intermediate portion of the same one panel and comprising the steps of:

feeding the continuous web in a longitudinal direction;

separating the inwardly turned edge portion and intermediate portion of the one panel forming the hem;

separating the two superposed panels;

feeding a flat continuous pliable strip along a first plane transversely between the separated panels and across the hem from an initial position outside the one side of the web to an extreme position between the panels;

reversing the direction of the fed strip;

transversely feeding the reversed strip along a second plane substantially parallel to and transversely displaced from the first plane from said extreme position between the panels to an intermediate position between the separated, inwardly turned and intermediate portions of the one panel;

folding the reversed strip from said transverse direction to said longitudinal direction within the hem; and longitudinally feeding the turned strip along a third plane substantially parallel to and transversely displaced from said first and second planes into the hem.

13. The method of claim 12 wherein the remaining panel of the elongated web is provided with a hem superposed with the hem of the one panel and formed by inwardly turning an elongated edge portion of the remaining panel along said one side of the web between the two panels and further comprising the steps of:

separating the inwardly turned edge portion and intermediate portion of the second panel forming the second hem between said web feeding and panel separating steps;

feeding a second flat continuous pliable strip transversely between the separated panels and across the pair of hems from a location outside the one side of the web to a position between the panels;

reversing the direction of the second strip;

transversely feeding the reversed second strip from said position between the panels to a position between the separated portions of the second hem;

folding the fed strip from said transverse direction to said longitudinal direction in the second hem; and longitudinally feeding the turned strip into the hem.

14. The method of claim 13 further comprising the step of:

continuously and uninterruptedly advancing the web and the two strips away from means performing the previous steps.

* * * * *